US005509617A

United States Patent [19]

Chen

[11] Patent Number: 5,509,617

[45] Date of Patent: Apr. 23, 1996

[54] ELASTIC YARN FEEDING APPARATUS

[76] Inventor: Jen H. Chen, 4FL, No. 27, Lane 160, Hsin Sheng S. Rd., Sec. 1, Taipei, Taiwan

[21] Appl. No.: 269,880

[22] Filed: Jul. 1, 1994

[30] Foreign Application Priority Data

Sep. 6, 1993 [CN] China ..... 93 2 23333.3

[51] Int. Cl.[6] ..... B65H 49/34

[52] U.S. Cl. ..... 242/564.5; 66/132 R

[58] Field of Search ..... 242/564, 564.5, 242/596, 596.3, 599.3, 599.4; 66/132 R

[56] References Cited

U.S. PATENT DOCUMENTS

| | | | |
|---|---|---|---|
| 2,168,159 | 8/1939 | Hartt | 242/564.5 |
| 3,209,558 | 10/1965 | Cargill | 66/132 R |
| 3,390,552 | 7/1968 | King | 66/132 R |
| 3,517,892 | 6/1970 | Laird et al. | 242/564.5 |
| 4,475,694 | 10/1984 | Reece | 242/564.5 |
| 4,651,938 | 3/1987 | Memminger et al. | 242/564.5 |
| 4,752,044 | 6/1988 | Memminger et al. | 66/132 R |

FOREIGN PATENT DOCUMENTS

| | | | |
|---|---|---|---|
| 5-237542 | 9/1993 | Japan | 242/564.5 |
| 1240803 | 6/1986 | U.S.S.R. | 66/132 R |
| 1120227 | 7/1968 | United Kingdom | 66/132 R |
| 2087440 | 5/1982 | United Kingdom | 242/564.5 |

*Primary Examiner*—John P. Darling
*Attorney, Agent, or Firm*—Pro-Techtor International

[57] ABSTRACT

An apparatus capable of feeding a roll of yarn wound around a bobbin to a knitting machine without having to apply tension to the yarn is provided. In the yarn feeding apparatus, the bobbin mounting frame for mounting the bobbin into operation position is rotatably supported by one end of a linkage bar. The other end of the linkage bar is pivotably coupled to a fixed horizontal bar. A driving shaft is positioned beneath the bobbin mounting frame such that the circumference of the yarn roll comes into contact with the driving shaft. The bobbin is thus driven to rotate when the driving shaft rotates. With this arrangement, the feeding of the yarn to the knitting machine would be smooth and stable in speed. The drawback of having to replace a new roll of yarn before the old one is completely used up is eliminated.

1 Claim, 6 Drawing Sheets

ELASTIC YARN FEEDING APPARATUS

BACKGROUND OF THE INVENTION

The present invention relates an elastic yarn feeding apparatus for use in knitting machines. In particular, the present invention relates to an elastic yarn feeding apparatus that is capable of feeding threads to knitting machines without applying tension to the threads.

Fabrics with soft, elastic texture are favored by people seeking high quality dresses. To make such fabrics, it is an important factor that, when feeding threads to the knitting machine, no-tension be applied on the threads. Should this be the case, although the knitted fabric may look flat and smooth in surface during the knitting process, the same fabric, however, after the knitting process is completed and the tension is removed, would become somewhat wrinkled due to the restoration of the stretched threads. The wrinkle on the surface of fabrics would exhibit a displeasing look.

A conventional no-tension yarn feeding apparatus is disclosed in German Patent Application No. P 32 33 869.4 (Taiwan Application No. 7228832), in which the bobbin holding the yarn is placed on and supported by a pair of horizontally extended driving rollers. Yarn feeding without applying tension to the threads is achieved by driving the two driving rollers to allow the circumference of the yarn wound around the bobbin to come into contact with the two rollers. This apparatus, although simple in structure and easy to operate, has the following drawback. In the apparatus, the distance between the two driving rollers (measured from the center axis of each roller) is fixed. This causes no problem in the beginning stage of supporting the bobbin for steady rotation. However, in the final stage of the knitting process when the yarn wound around on the bobbin is reduced due to consumption, the reduction in weight of the yarn would cause the bobbin to quiver and rotate in unstable speed. This may even cause the bobbin to jump off the supporting rollers, thereby interrupting the knitting process.

To prevent quivering and instability in speed of the bobbin from taking place, the bobbin along with the remaining yarn is replaced with a new roll of yarn at a certain point in the final stage. The remaining yarn on the bobbin is thus wasted. Operators of the knitting machine thus often have to pay high attention to watch for the undesired conditions in the final stage of the knitting process so as to make the replacement promptly. This causes a waste in the material and thus high fabrication cost.

SUMMARY OF THE INVENTION

It is a primary objective of the present invention to provide an elastic yarn feeding apparatus that is capable of feeding threads to a knitting machine without applying tension to the threads.

In accordance with the above and other objectives, a yarn feeding apparatus is provided. In the yarn feeding apparatus, the bobbin mounting frame for mounting the bobbin into operation position is rotatably supported by one end of a linkage bar. The other end of the linkage bar is pivotably coupled to a fixed horizontal bar. A driving shaft is positioned beneath the bobbin mounting frame such that the circumference of the yarn wound around the bobbin comes into contact with the driving shaft. The circumference of the yarn roll is thus driven to rotate when the driving shaft rotates.

The second end of the linkage bar can be provided with a hook portion. The linkage bar thus can be pivotably coupled to the fixed horizontal bar by manually placing the hook portion on the fixed horizontal bar. And the hook portion can be disengaged with the fixed horizontal bar simply by manual lifting.

BRIEF DESCRIPTION OF THE DRAWINGS

The present invention can be more fully understood by reading the subsequent detailed description of the preferred embodiments thereof with references made to the accompanying drawings, wherein.

DETAILED DESCRIPTION OF THE PREFERRED EMBODIMENTS

Figure 1:
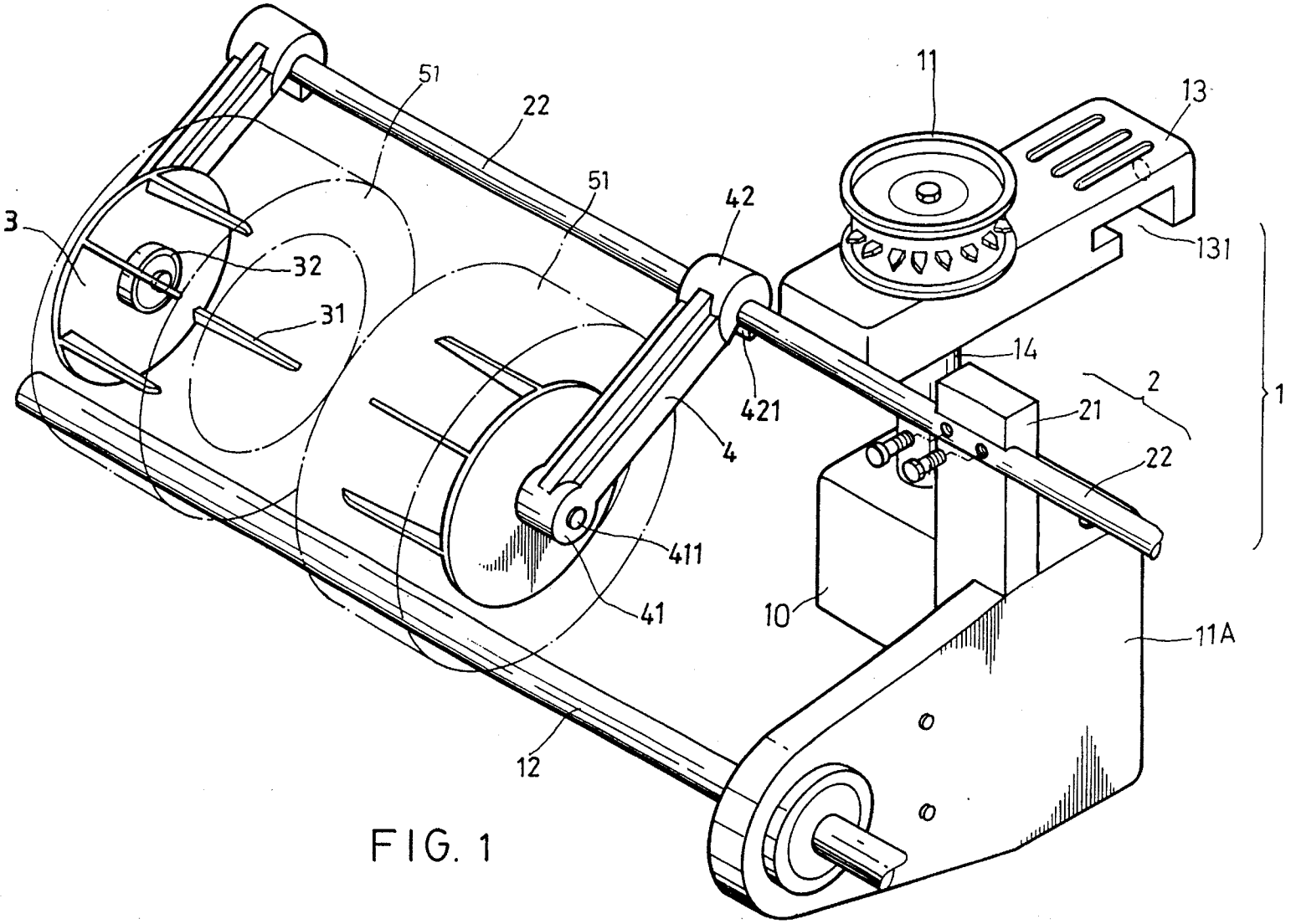
FIG. 1 is a perspective view of a yarn feeding apparatus according to the present invention.
Figure 2:
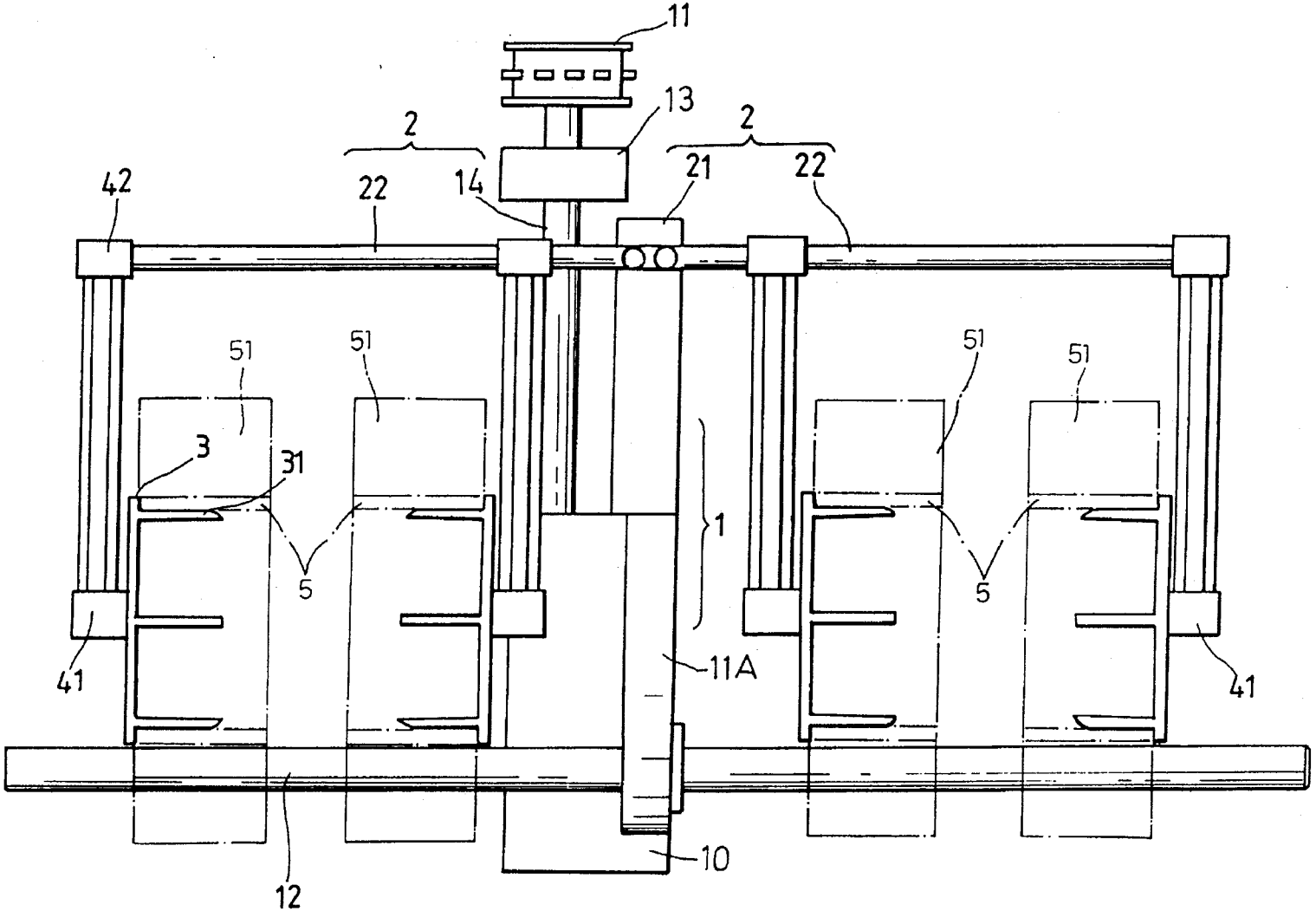
FIG. 2 is a side plan view of the yarn feeding apparatus according to the present invention.
Figure 3:
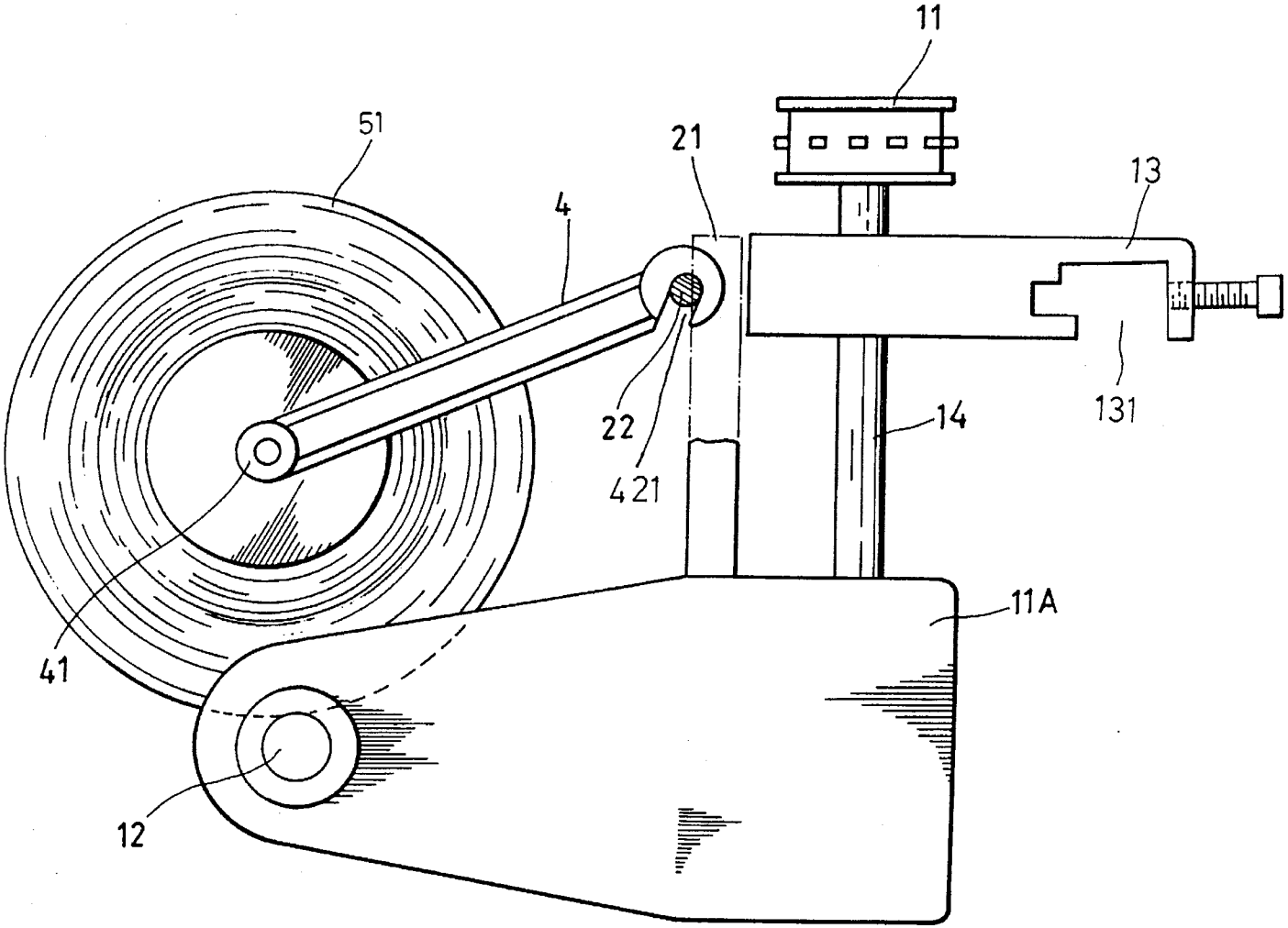
FIG. 3 shows the first preferred embodiment of the yarn feeding apparatus according to the present invention.

Referring to FIGS. 1–3, a yarn feeding apparatus made according to the present invention is composed of a power transmission mechanism 1, a driving unit 10, a gear box 11A, a standing post 14, an engaging member 13, a transmission wheel 11, and a driving shaft 12. The power transmission mechanism 1 is integrally formed in housing and internally connected with the gear box 11A. The standing post 14 is placed in upright position on the driving unit 10 and extended upwards therefrom. The transmission wheel 11 is provided on top of the standing post 14 and the engaging member 13. The driving shaft 12 is provided at the lower end of the gear box 11A.

The power transmission mechanism 1 is used to transfer mechanical power from a driving motor (not shown) via the transmission wheel 11 to the interior of the driving unit 10 and the gear box 11A for variable-speed transmission. The driving shaft 12 is thus rotated with a desired speed.

A horizontal bar securing structure 2 is used to secure a horizontal bar 22. The securing structure is provided with a supporting member 21, which is placed in upright position on the driving unit 10. The horizontal bar 22 is bolted to the supporting plate 21 and placed above and in parallel to the driving shaft 12.

Figure 9:
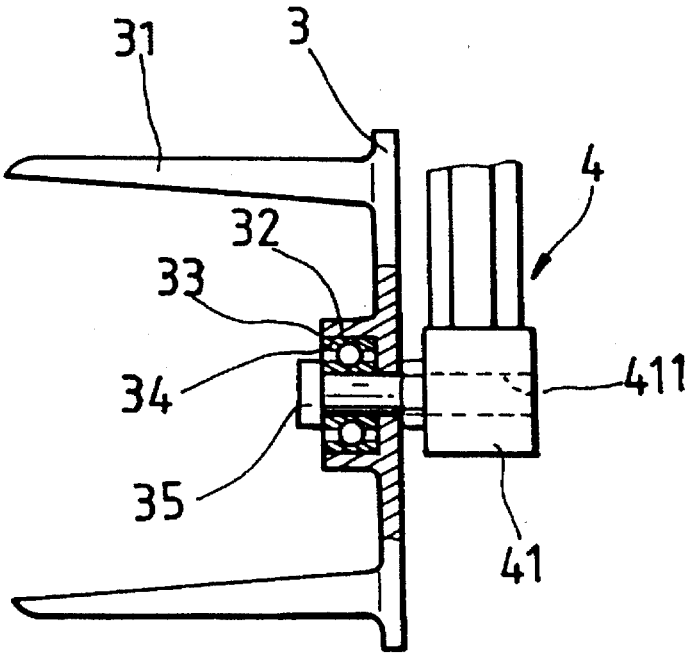
FIG. 9 shows how the bobbin mounting frame is coupled to the linkage bar.

As shown in FIG. 9, the bobbin mounting frame is formed by a pair of circular plates 3, each having a number of pins 31 on the edge, a circular protrusion 32 at the center of inner side, and a circular recess 33 for supporting a bearing 34.

Figure 5:
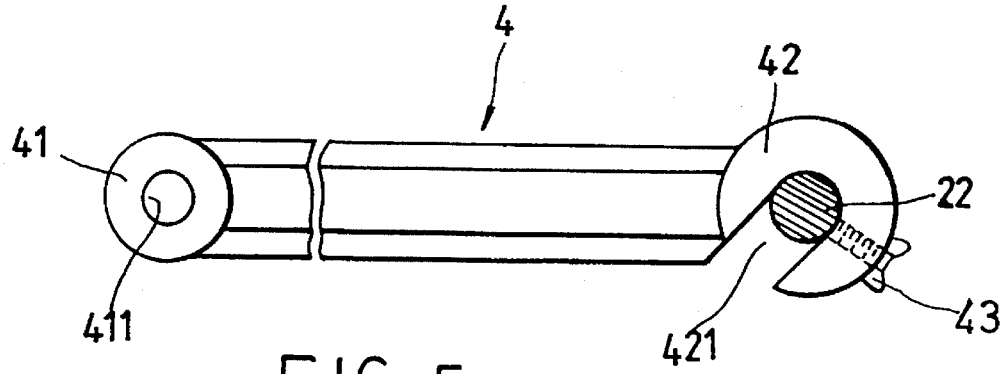
FIG. 5 is a schematic diagram, showing how the hook portion of a linkage bar is hooked to a fixed bar.

An engaging head 41 is provided at one end of the linkage bar 4. An engaging hole 411 is formed at the center of the engaging head 41, allowing engagement with the engaging rod 35 so as to engage the disk 3 with the linkage bar 4. The engaging hole 411 thus supports the rotation of the bobbin mounting frame. In addition, as shown in FIGS. 1, 3 and 5, a hook portion 42 is provided at the other end of the linkage bar 4, allowing engagement of the linkage bar 4 with the fixed horizontal bar 22 secured by the securing member 2.

The engaging rod 35 on the bearing 34 mounted in the recess 33 on the disk 3 is inserted into corresponding hole. The engaging rod 35 is thus engaged with the hole 411 on the engaging head 41 at the end of the linkage bar 4, thereby coupling the disk 3 to the linkage bar 4. Furthermore, the plurality of pins 31 on the circular plate 3 can be inserted into an inner surface of the bobbin, thereby mounting a roll of yarn 51, which is wound around a bobbin, onto the bobbin mounting frame. For longer bobbins, the insertion is made at two ends; and for shorter bobbins, the insertion can be made at one end, as shown by the imaginary lines in FIGS. 1 and 2.

The circumference of the yarn roll 51, after being inserted into position, is placed in contact with the driving shaft 12, thereby allowing the yarn roll 51 to be driven by the rotation of the driving shaft 12. Furthermore, by means of the opening 421 on the hook portion 42 of the linkage bar 4, the yarn roll 51 is hooked to the fixed horizontal bar 22 on the securing member 2. With this arrangement, when the power generated by the driving motor (not shown) is transferred via the transmission wheel 11 into the power transmission mechanism 1 for variable-speed power transmission. Subsequently, the driving force is output from the power transmission mechanism 1 by means of the driving shaft 12. The yarn roll 51 is thus driven to rotate at a constant speed, thereby feeding threads on the yarn roll 51 to the knitting machine for knitting fabrics. In the structure of the apparatus, the disk 3 and the linkage bar 4 is coupled; the hook portion 42 of the linkage bar 4 is hooked to the fixed horizontal bar 22; and the groove 421 on the hook portion 421 is able to adapt itself in angle with respect to the rotation of the fixed horizontal bar 22. As a consequence, when the elastic yarn wound on the bobbin 5 is gradually reduced in amount, the yarn roll 51 would nonetheless maintain rotatable contact with the driving shaft 12, allowing the feeding of the remaining yarn on the bobbin 5 to proceed at stable speed. When the yarn on the bobbin 5 is completely depleted, the empty bobbin can be removed along with the linkage bar so as to replace with a new roll of yarn. After that, the bobbin in the new yarn roll can be fit into position simply by hooking the linkage bar.

Figure 4:
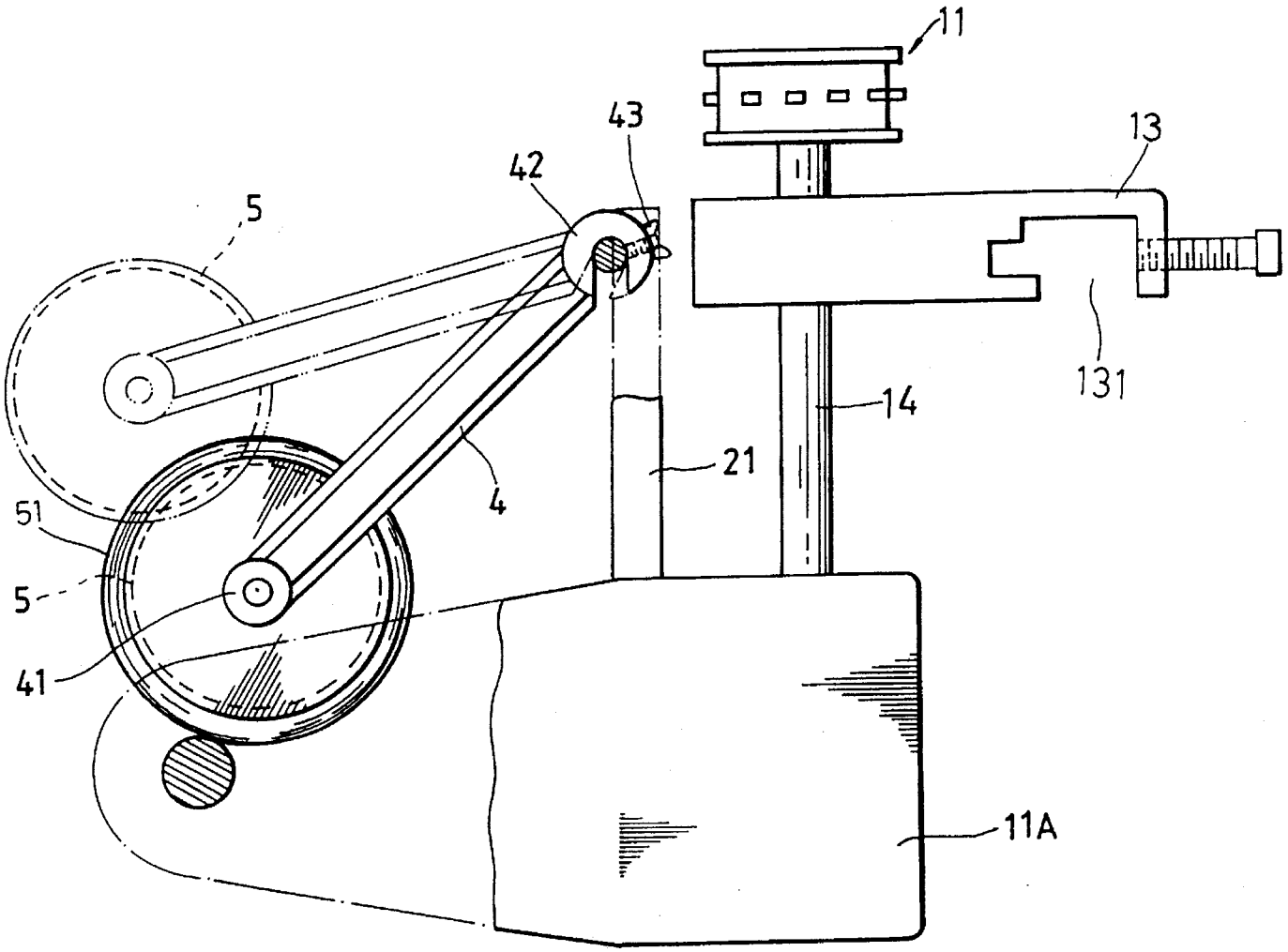
FIG. 4 shows the second preferred embodiment of the yarn feeding apparatus according to the present invention.
Figure 6:
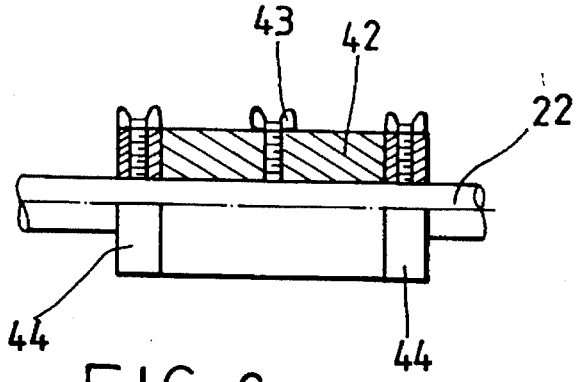
FIG. 6 shows the same parts of FIG. 5 except viewing from a different side.
Figure 7:
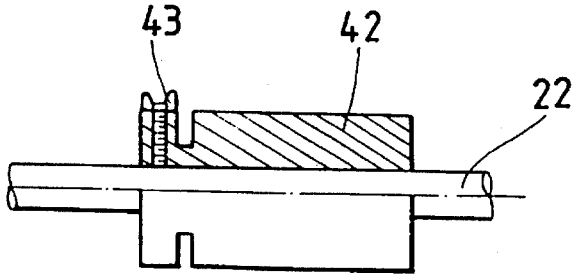
FIG. 7 shows another embodiment of the device shown in FIG. 6.
Figure 8:
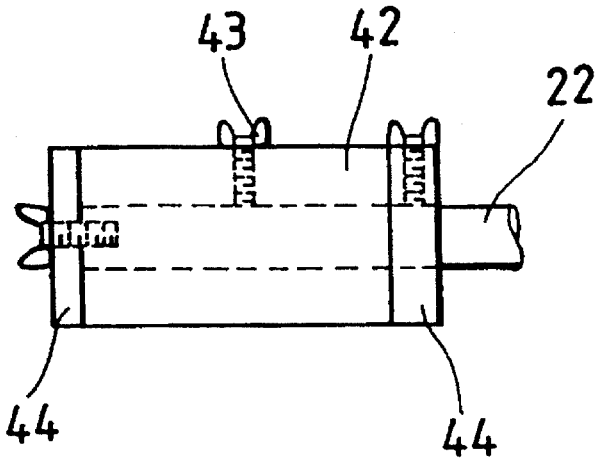
FIG. 8 shows still another another embodiment of the device shown in FIG. 6.

When the knitting machine is temporarily not in use, the bobbin can be removed from the yarn feeding apparatus along with the linkage bar. This can be achieved simply by manually lifting the hook portion of the link bar off from the fixed horizontal bar. Alternatively, the linkage bar 4 can be shifted upwards for an angle (as indicated by the imaginary line in FIGS. 4 and 5), so that the bobbin 5 along with the remaining yarn can be moved away from contacting with the driving shaft 12. Since the hook portion 42 of the linkage bar 4 is provided with a butterfly screw 43, the linkage bar 4 can be fastened to the fixed horizontal bar 22. In addition, as shown in FIGS. 6, 7 and 8 a stop ring 44 is provided at each of the two ends of the hook portion 42 for preventing the hook portion 42 from sliding on the fixed horizontal bar 22.

The present invention has been described hitherto with exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An apparatus for feeding a roll of yarn wound around a bobbin to a knitting machine comprising:

(a) a bobbin mounting frame for mounting the yarn roll in operating position;

(b) at least one linkage bar, said linkage bar having (1) a first end that supports a rotation center of said bobbin mounting frame, and (2) a second end pivotably connected to a fixed horizontal bar, wherein the second end of said linkage bar is provided with a hook portion, said hook portion being pivotably mounted on said fixed horizontal bar such that said hook portion can be removed from said fixed horizontal bar by manual lifting; and (c) a driving shaft positioned beneath said bobbin mounting frame such that the outer surface of the yarn roll contacts said driving shaft, said bobbin thereby being rotated when said driving shaft rotates.

* * * * *